US010250994B2

(12) United States Patent
Griffiths

(10) Patent No.: US 10,250,994 B2
(45) Date of Patent: Apr. 2, 2019

(54) FORCE BALANCED MICRO TRANSDUCER ARRAY

(71) Applicant: Dolby International AB, Amsterdam Zuidoost (NL)

(72) Inventor: Kelvin Francis Griffiths, Bridgend (GB)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/459,335

(22) Filed: Mar. 15, 2017

(65) Prior Publication Data

US 2017/0272866 A1 Sep. 21, 2017

Related U.S. Application Data

(60) Provisional application No. 62/310,050, filed on Mar. 18, 2016.

(51) Int. Cl.

| | |
|---|---|
| ***H04R 1/06*** | (2006.01) |
| ***H04R 1/32*** | (2006.01) |
| ***H04R 1/34*** | (2006.01) |
| ***H04R 9/06*** | (2006.01) |
| ***H04R 9/02*** | (2006.01) |
| ***H04R 7/20*** | (2006.01) |

(52) U.S. Cl.

CPC ..... *H04R 9/063* (2013.01); *H04R 1/06* (2013.01); *H04R 1/323* (2013.01); *H04R 1/345* (2013.01); *H04R 9/025* (2013.01); *H04R 2209/041* (2013.01); *H04R 2499/11* (2013.01)

(58) Field of Classification Search

CPC ..... H04R 1/06; H04R 1/323; H04R 9/063; H04R 2209/041; H04R 2499/11

USPC ..... 381/401–410, 315

See application file for complete search history.

(56) References Cited

U.S. PATENT DOCUMENTS

| | | | | |
|---|---|---|---|---|
| 4,841,977 | A * | 6/1989 | Griffith | A61B 8/12 29/25.35 |
| 7,539,318 | B2 | 5/2009 | Onuma | |
| 8,290,198 | B2 | 10/2012 | Ogasawara | |
| 8,452,041 | B2 | 5/2013 | Nedelcu | |
| 2003/0123692 | A1 | 7/2003 | Ueki | |

(Continued)

FOREIGN PATENT DOCUMENTS

| | | |
|---|---|---|
| GB | 2376371 | 12/2002 |
| JP | H11-41685 | 2/1999 |

(Continued)

*Primary Examiner* — Curtis A Kuntz
*Assistant Examiner* — Julie X Dang

(57) ABSTRACT

Embodiments are directed to a micro transducer array comprising a shared motor system having a base plate and mounting interfaces to a frame of a portable electronic device; a first transducer comprising a first magnet disposed between the base plate and a first top plate, and a first diaphragm projecting sound out of a surface of the portable device; a second transducer comprising a second magnet disposed between the base plate and a second top plate, and a second diaphragm projecting sound of an opposite surface of the portable device; a first pair of input terminals inputting a first audio signal to the first transducer; and a second pair of input terminals inputting a second audio signal to the second transducer.

15 Claims, 7 Drawing Sheets

(56) References Cited

U.S. PATENT DOCUMENTS

| | | | | |
|---|---|---|---|---|
| 2003/0233229 | A1* | 12/2003 | Tseng | G10L 25/48 704/212 |
| 2008/0317255 | A1* | 12/2008 | Cozens | H04R 9/10 381/71.6 |
| 2009/0147980 | A1* | 6/2009 | Fincham | H04S 1/002 381/352 |
| 2010/0194440 | A1* | 8/2010 | Drogi | H03F 1/0205 327/3 |
| 2013/0156215 | A1* | 6/2013 | Hickerson | H04R 1/1091 381/74 |
| 2013/0305152 | A1* | 11/2013 | Griffiths | G06F 3/04883 715/716 |
| 2014/0270276 | A1* | 9/2014 | Iwakura | H02K 35/06 381/190 |
| 2014/0363034 | A1 | 12/2014 | Kim | |
| 2016/0234618 | A1* | 8/2016 | Honda | H04R 1/02 |

FOREIGN PATENT DOCUMENTS

| | | |
|---|---|---|
| KR | 2000-0072633 | 12/2000 |
| WO | 2006/089995 | 8/2006 |

* cited by examiner

FORCE BALANCED MICRO TRANSDUCER ARRAY

CROSS-REFERENCE TO RELATED APPLICATION(S)

The present application claims priority to U.S. Provisional Patent Application No. 62/310,050, filed Mar. 18, 2016, which is incorporated herein by reference in its entirety.

FIELD OF THE INVENTION

One or more implementations relate generally to audio transducers, and more specifically to a force balanced micro transducer array using opposing forces to reduce vibrations and distortion.

BACKGROUND

The increased use of small portable computers, tablet devices, and smartphones to playback movies, videos, high quality audio, as well as to support audio-intensive applications such as games, simulators, Audio/Visual content production, and so on. Because of their small size and deployment in portable devices that are often used while being held or not firmly affixed to a solid surface (e.g., desk or table), the speakers and drivers are often subject to relatively significant amounts of vibration and external movement. Because rare earth magnets are employed which are considerably smaller and lighter than conventional ceramic types, the magnet experiences increased mobility and becomes a source of vibration transmitted throughout the entire device body if attached mechanically. These effects can produce distortion that compromises the quality of the output audio. Stray vibrations have been found to be a particular problem on small mobile devices such as tablets, laptops and mobile phones because various components vibrate audibly. This effect translates directly to electroacoustic distortion when audio content is played through the speakers of the device. The tuning process is also affected by vibrations as the system is deliberately turned down to avoid buzzing sounds. A system less susceptible to buzzing distortions due to effective vibration control can be tuned to be louder and encompass a wider range of frequencies.

Certain motion canceling designs have been developed to minimize distortion in multi-driver speakers. For example, push-pull opposing drivers can be wired in-phase to cancel driver motion or out-of-phase to cancel harmonic distortion. Such designs, however, are limited to large speakers, such as subwoofers, which have drivers on the order of 12 to 18 inches, or similar. Such large speakers are obviously impractical for small, portable computers and playback devices.

What is needed, therefore, is an audio transducer design that minimizes the effects of distortion caused by vibration and movement of the device in which they are mounted.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to an audio transducer array comprising a shared motor system having a base plate and mounting interfaces to a frame of a portable electronic device; a first transducer comprising a first magnet disposed between the base plate and a first top plate, and a first diaphragm projecting sound out of a surface of the portable device; a second transducer comprising a second magnet disposed between the base plate and a second top plate, and a second diaphragm projecting sound of an opposite surface of the portable device; a first pair of input terminals inputting a first audio signal to the first transducer; and a second pair of input terminals inputting a second audio signal to the second transducer. The first and second transducers comprise a transducer array that is configured to be of a size approximating 1 inch long by ½ inch wide by ¼ inch deep. The first and second magnets are rare earth magnets and may each comprise a neodymium magnet. The second audio signal may comprises the first audio signal in a phase relationship of one of: zero degree in-phase, and out-of-phase up to a 180 degree phase shift; or the second audio signal may be different than the first audio signal. The second audio signal may be dependent on the first audio signal and augments the first audio signal to produce a desired sound effect for the first audio signal. The portable device housing the transducer array may be one of a laptop computer, a notebook computer, a tablet computer, a mobile phone, or a handheld game device.

Embodiments are further directed to a portable electronic device comprising: a body portion having a first surface and an opposite facing second surface wherein the first and second surfaces are disposed on an order of ¼ inch to ½ inch apart; and a force balanced micro transducer array placed in the body portion and having a shared motor system with a base plate, and mounting interfaces to the body portion; a first transducer comprising a first magnet disposed between the base plate and a first top plate, and a first diaphragm projecting sound out of the first surface; a second transducer comprising a second magnet disposed between the base plate and a second top plate, and a second diaphragm projecting sound of the second surface.

Embodiments are yet further directed to methods of making and using or deploying the force balanced micro array transducer array and/or portable device including the transducer array.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Systems and methods are described for a force balanced transducer array that comprises two drive units facing in opposite directions with their motors attached to each other. The opposing forces generated on the motors that would normally generate stray vibrations and cause buzzing distortions, cancel each other out resulting in practically all of the force generated by the motor being devoted to intended diaphragm motion. The motor system is packaged as a unitary, one-piece system to ensure physical security and reduce complexity and parts cost. In this system, the vibrational energy generated by the transducer is used to radiate sound and not to excite other structures in the device attached to the transducer or magnet, such as the body or support structure of a portable communication or computing device.

Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
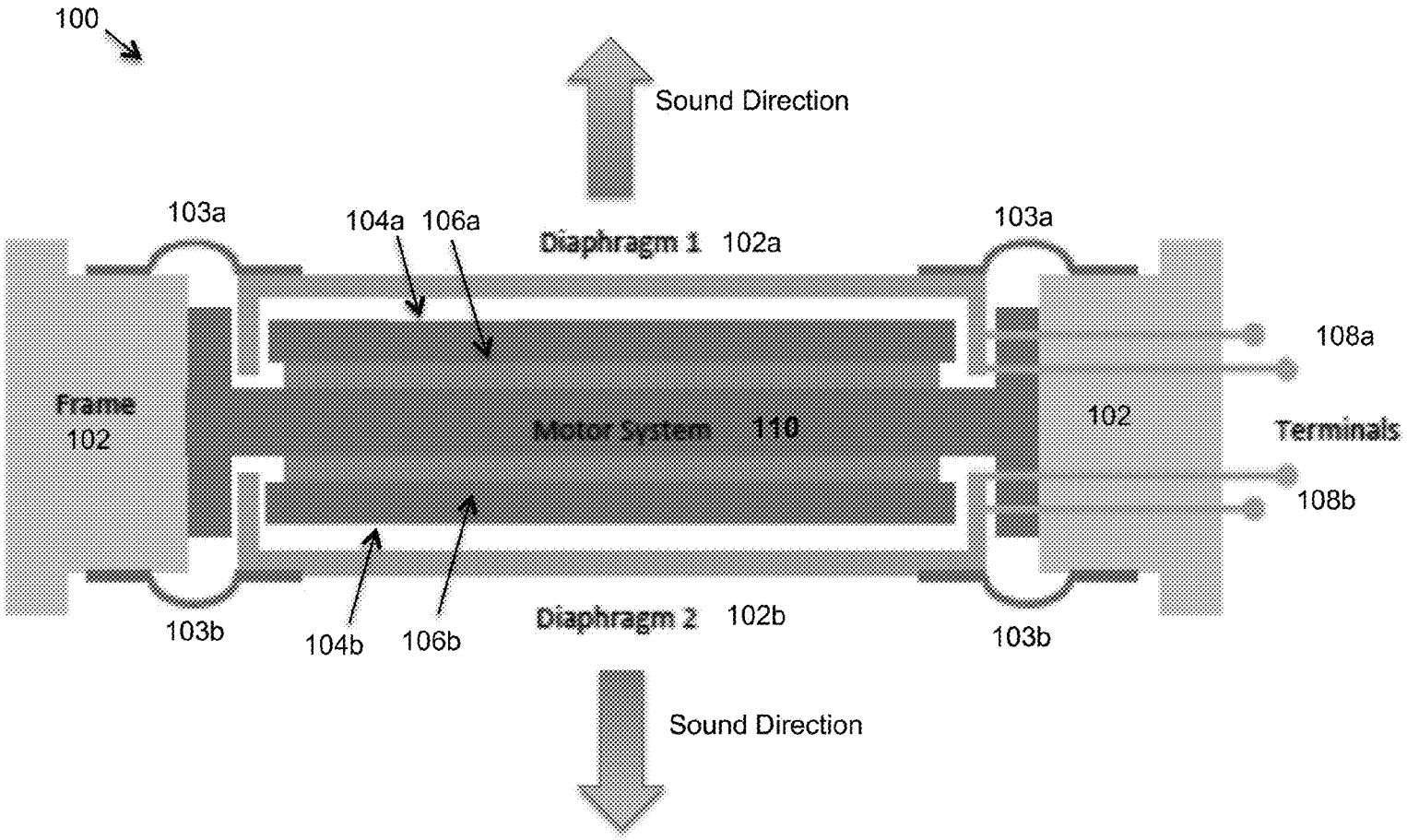
FIG. 1 illustrates a force balanced micro transducer array under some embodiments.

FIG. 1 illustrates a force balanced micro transducer array under some embodiments. As shown in FIG. 1, transducer array 100 comprises a motor system 110 placed within a frame 102 of a device (e.g., phone, tablet, laptop/notebook computer, etc.) and that drives two opposing diaphragms 102*a* and 102*b*. The diaphragms are attached to the frame through flexible couplings (103*a*, 103*b*) and move up/down (in/out) relative to the motor system to project sound outward from the frame 102. The motor system 110 comprises a single base unit or plate that is shared by the first transducer array that drives diaphragm 1 (102*a*) and the second transducer array that drives diaphragm 2 (102*b*). The first transducer array has a magnet 106*a* sandwiched between the base plate and top plate 104*a*, while the second transducer array has a magnet 106*b* sandwiched between the base plate and top plate 104*b*. Respective voice coils move the diaphragms in an orthogonal direction in response to the audio signal provided from terminals 108*a* and 108*b*. For the embodiment shown, a respective pair of audio input terminals 108 is provided to each of the two transducers.

In a standard single transducer device, when the voice coil is excited using AC signal, the diaphragm moves in one direction and the motor moves fractionally in the other direction. In transducers that use heavy magnets (e.g., ferrite or alnico magnets), this fractional movement is typically insignificant and therefore electroacoustic distortion is practically non-existent. In modern micro-size applications however, much lighter and smaller magnets are used. In an embodiment, magnets 106*a* and 106*b* comprise rare earth magnets, such as neodymium (NdFeB) magnet, which is a widely used rare-earth permanent magnet. Embodiments are not so limited, however, and other rare earth magnets may also be used, such as samarium-cobalt magnets, and any other appropriate powerful, small-scale permanent magnet.

In general, lighter NdFeB type motors suffer greater effects of vibration or "kick back" from the diaphragm movement due to their lightweight relative to the diaphragm. Thus stray vibrations are significant and have become a major issue for small speakers used in portable devices. The transducer array 100 of FIG. 1 essentially comprises two transducers (speakers) that share components of the same motor system. The base plate 110 and frame are shared between the two speaker systems. The voice coils, magnets 106*a,b*, top-plates 104*a,b*, flexible couples 103*a,b* and diaphragms 102*a,b* are unique for each transducer; in an embodiment, these are matched pairs of substantially identical components, e.g top-plate 104*a* is substantially identical to top-plate 104*b*. By having opposing transducers in a single array, these opposing forces are cancelled and all the vibrational energy is committed to moving the respective diaphragm as intended.

In an embodiment, the audio signals transmitted to each transducer through the respective terminal 108*a* and 108*b* may be configured to maximize the force balancing effect of the opposing diaphragms and to minimize or eliminate vibration of the device frame 102. For this embodiment, identical signals may be input to each transducer with the first signal shifted in phase relative to the second signal, such as by 180 degrees. In this case, the same signal may be transmitted to terminals 108*a* and 108*b*, with the terminal connections of terminals 108*b* reversed relative to 108*a* to create the desired phase shift.

Figure 2A:
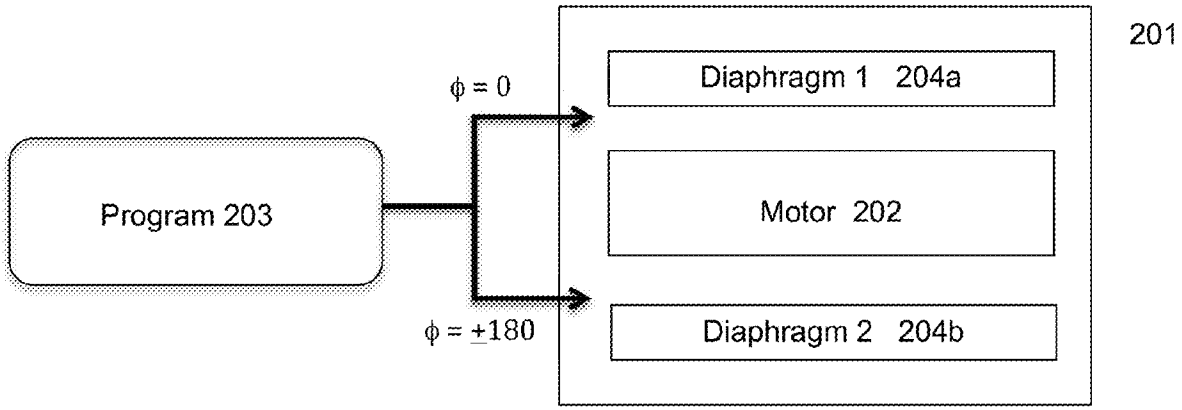
FIG. 2A illustrates the transducer array used in a single-input mode, under some embodiments.
Figure 2B:
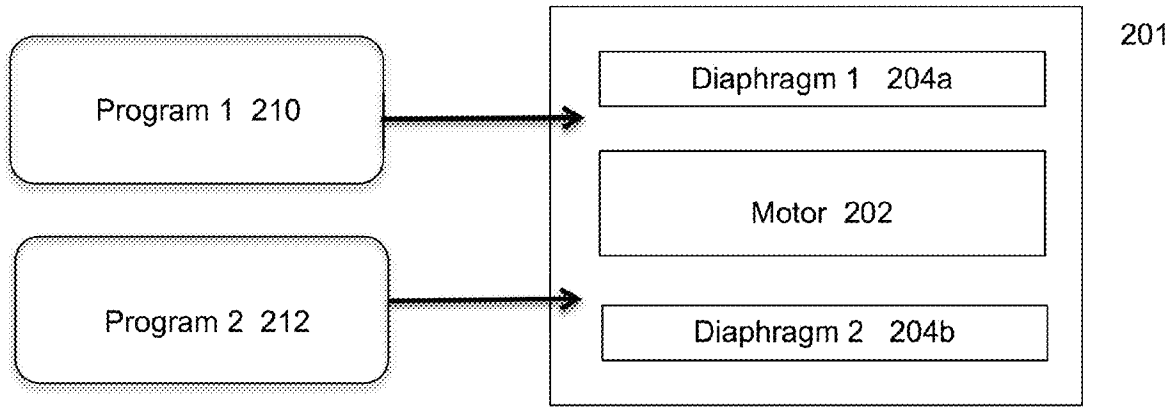
FIG. 2B illustrates the transducer array used in a multi-input mode under some embodiments.

The force-balanced micro transducer array may also be used in a multi-mode configuration in which different signals are transmitted to terminals 108*a* and 108*b*. FIG. 2A illustrates the transducer array used in a single-input mode, under some embodiments, while FIG. 2B illustrates the transducer array used in a multi-input mode under some embodiments. In FIGS. 2A and 2B, a transducer array 201 comprises a motor 202 driving two opposing diaphragms 204*a* and 204*b*, with each transducer driven by respective sets of input terminals, as shown in FIG. 1. As shown in FIG. 2A, in the single-input mode, the audio signal for a single program 203 is input into both sets of terminals for the transducer array 201. The phase of the input to the diaphragm 1 transducer may be input at a first phase (e.g., $\phi=0$ degrees), while the input to the diaphragm 2 transducer may be input with a phase shift of 180 degrees so that the movement of the two opposing diaphragms counteract the movement of the motor which is directly attached to the frame or casing of the device. The phase shift between the two inputs may be performed in any appropriate manner, such as by reversing the input connections, performing a DSP phase shift operation, delaying the second input relative to the first, and so on.

In an embodiment, the first and second inputs are in-phase so that $\phi=0$. Owing of the layout of the loudspeakers and assuming that the voice coils are wound in a consistent direction, in-phase operation allows both pistons to move outward in opposite directions. It is usual that at low frequencies, the content is mono and therefore this equal and opposite operation is maintained in the frequency band that matters most for vibration control (around resonance). In this case, a positive half cycle waveform would result in a diaphragm displacement away from the motor. In alternative embodiments, some phase shift might be advantageous depending on the actual movement and vibration problems that are being overcome.

In the multi-input embodiment shown in FIG. 2B, the audio signal for a first program 210 is input into the set of terminals for the transducer array driving diaphragm 204*a*, and the audio signal for a second program 212 is input into the set of terminals for the transducer array driving diaphragm 204*b*. The programs 1 210 and 212 may be totally independent programs such that the two transducers within array 201 play different audio content.

In an embodiment, the force-balanced transducer array is produced in a form factor that facilitates its mounting and use in small portable devices, such as handheld mobile (cellular) phones, tablet computers, laptop/notebook computers, game devices, and so on. For this embodiment, a nominal size of the transducer array may be of the scale of 1 inch long by ½ inch wide by ¼ inch deep (1"×½"×¼") or any similar dimensions depending on application requirements and device constraints.

Figure 3:
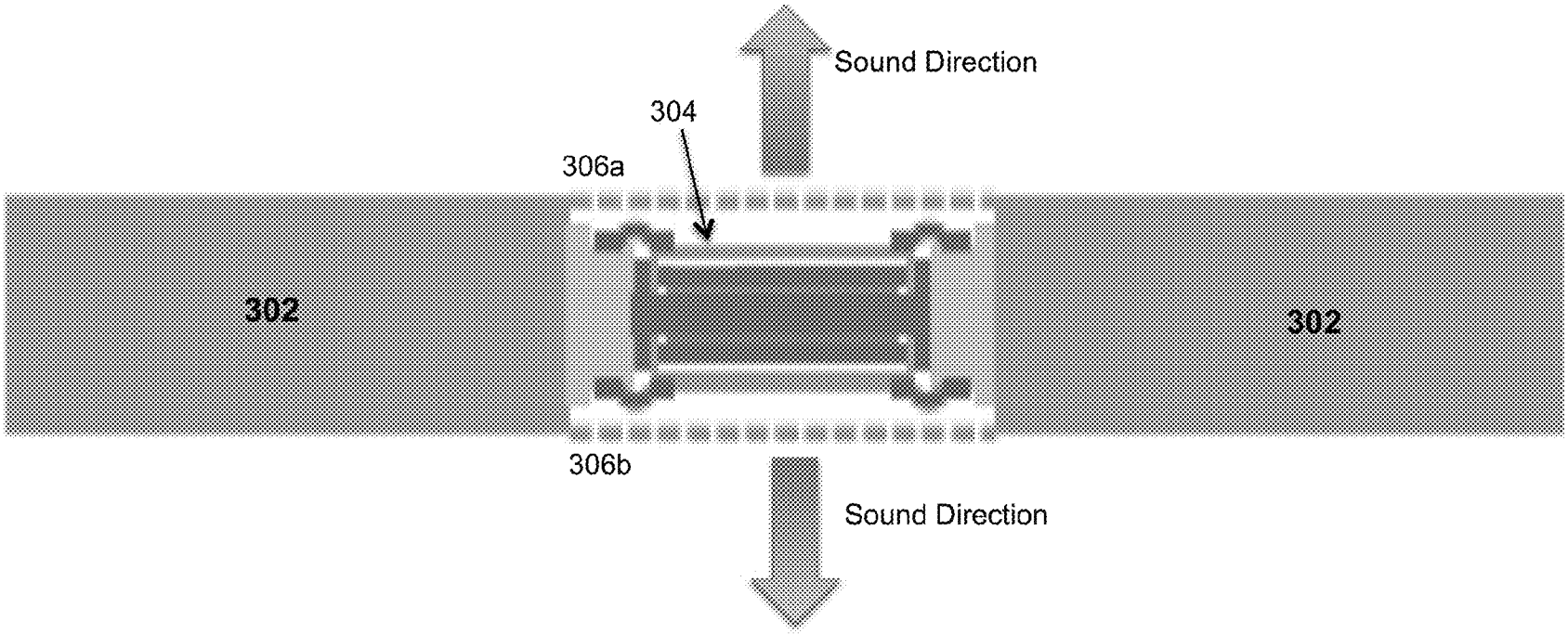
FIG. 3 illustrates a force-balanced micro transducer array mounted in a device, under some embodiments.

In an embodiment, the transducer array is configured to be mounted such that the opposed diaphragms radiate sound forwards and backwards through apertures in the front and rear or front and back surfaces of the device. FIG. 3 illustrates a force-balanced micro transducer array mounted in a device, under some embodiments. As shown in FIG. 3, the micro transducer array 304 is mounted in a device casing 302 such that the respective diaphragms radiate sound out of opposite sides of the case. Each diaphragm may be covered and protected by a grill or screen 306*a* and 306*b* that covers the speaker and blends with the rest of the case. The case may represent the lid of a notebook computer, the body of a phone or tablet, or some other relatively thin body portion of the portable/mobile device.

Figure 4:
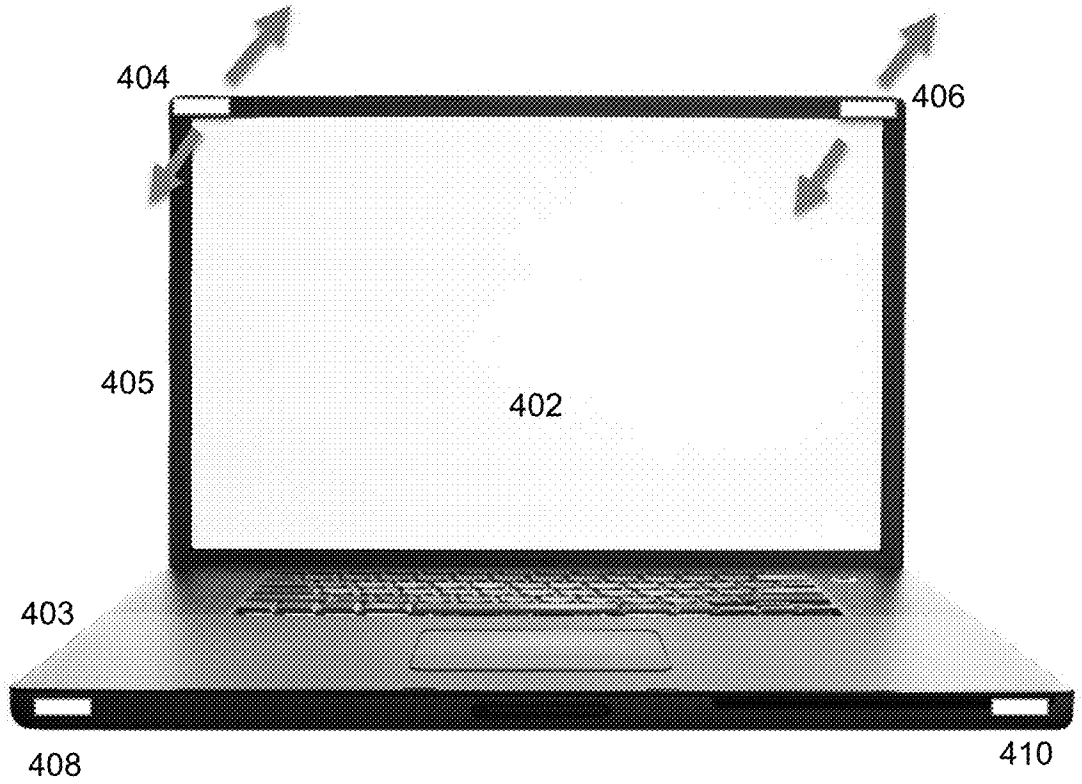
FIG. 4 illustrates installation of a force-balanced micro transducer array in a portable computer, under some embodiments.

FIG. 4 illustrates installation of a force-balanced micro transducer array in a portable computer, under some embodiments. As shown in FIG. 4, notebook or laptop computer 402 comprises a main body 403 housing keyboard and trackpad with a display screen mounted in lid portion 405. The lid 405 is typically on the order of ¼ to ½ inch in depth, or any other similar measurement. Transducer arrays 404 and 406 are mounted in the upper corners of the lid 405 such that the first diaphragm of each transducer projects sound out the front surface of the lid (e.g., toward the user), and the opposing diaphragm of each transducer projects sound out the back surface of the lid (e.g., away from the user). Placement of the transducer arrays in the computer of FIG. 4 is intended for illustration only, and other appropriate locations are also possible, such as along a bottom or side edge of the lid 405 or in the body 403, such as shown for transducers 408 and 410.

Figure 5:
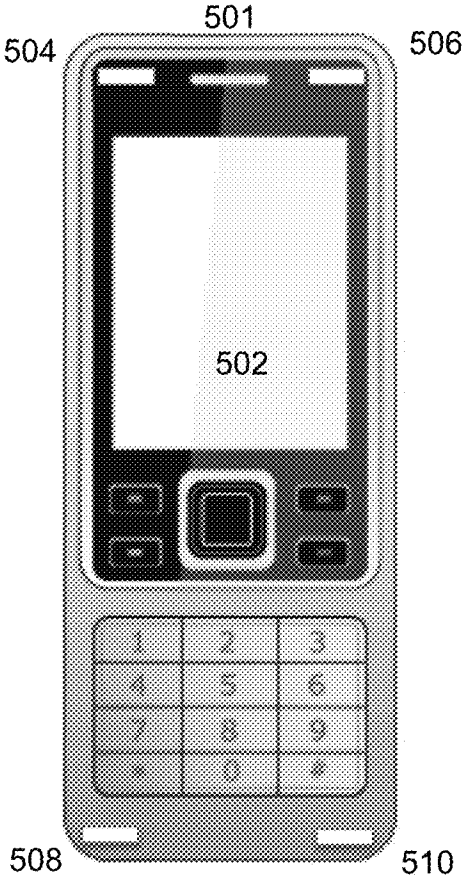
FIG. 5 illustrates installation of a force-balanced micro transducer array in a mobile phone, under some embodiments.

As stated above, the transducer array may be used in many different devices. FIG. 5 illustrates installation of a force-balanced micro transducer array in a mobile phone, under some embodiments. For the example of FIG. 5, a mobile phone 502 includes a display with a physical or touch screen alpha/numeric input pad and one or more function buttons. Micro transducer arrays 504 and 506 may be placed in any appropriate location of the phone such that the two opposing transducers radiate sound out of the front and back surfaces of the phone 502. Two or more pairs of transducer arrays may be used, such as shown by transducer array pair 504/506 in the top corners of the phone and transducer array pair 508/510 in the bottom corners of the phone. The micro array transducers may augment or replace any native single-driver speaker 501 that may be included with the phone. The location of the transducer arrays in FIG. 5 is intended to be for example only, and any other practical location or configuration is also possible.

As illustrated in FIGS. 2A and 2B, the audio signal going to each side of the transducer can either be the same signal or different signals for different programs. In a single program implementation, the same phase shifted signal can be used to minimize or eliminate buzz or distortion due to vibration of the motor and diaphragms within the device casing. In this case, the transducer is located so that sound is radiated from both sides and is force balanced to avoid vibration of the device casing. If multi-mode operation is required, the signals going to the facing diaphragm could be flipped in phase to permit consistent audio experience in all device modes.

For the multi-mode case in which different program signals are input to the different transducers of the array (e.g., FIG. 2B), the different programs may be selected so that the audio content is enhanced by playing a first program through the first transducer and a second program through the second (opposite) transducer where there is a dependence of the second program on the first program. For example, a desirable surround effect could be implemented in one of the channels to augment the program played through the first channel. For example, the second program may be temporally shifted by a certain phase (ϕ) to provide a time delay that creates reverb, echo or a general sense of space. The second program may be any appropriate sound processed version of the first program to create other similar effects. For example, the radiation from the diaphragm farthest from a single device aperture could be routed and horn loaded to augment the radiation from the closest diaphragm.

Figure 6:
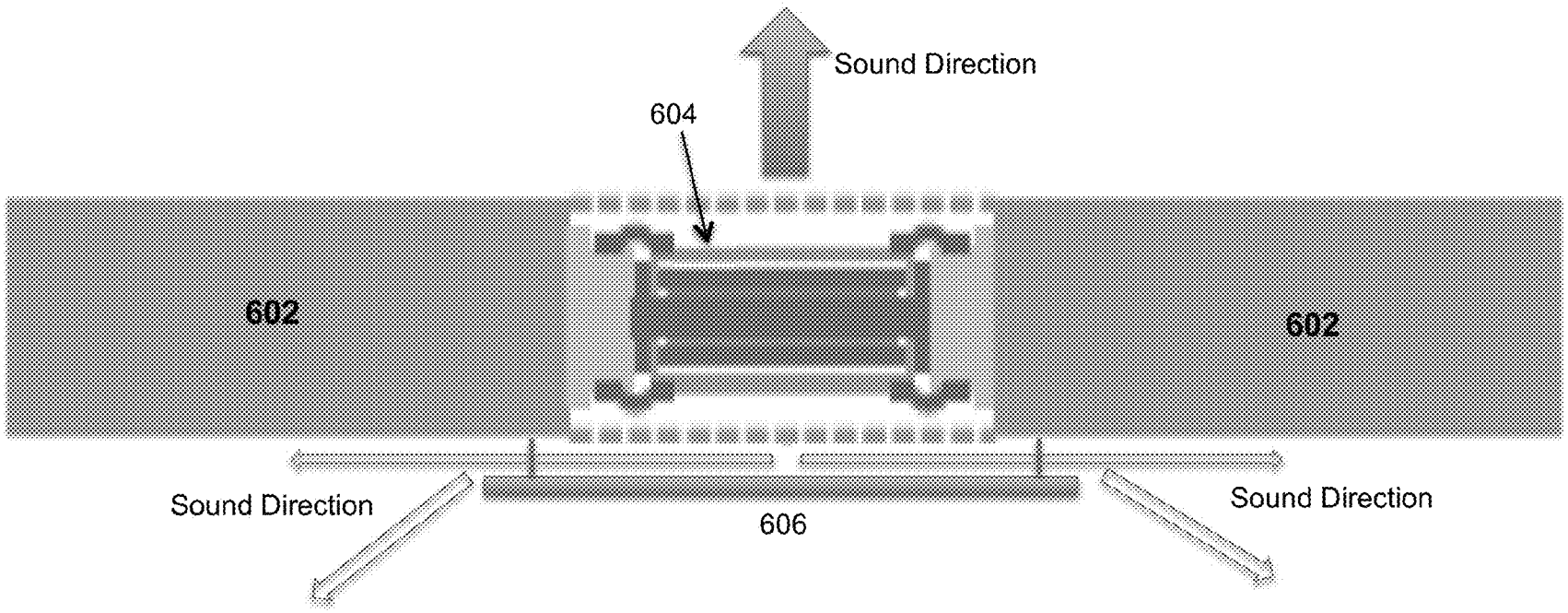
FIG. 6 illustrates a portable device having a micro array transducer and a reflective baffle, under an embodiment.

In an embodiment, the placement of the micro array transducer in a device such that sound is projected in opposite side or surfaces of the device is used to generate reflected sound that can further augment the audio signals played from the device. For this embodiment, the device may include one or more baffles or reflective structures to direct the sound appropriately in the desired directions. FIG. 6 illustrates a portable device having a micro array transducer and a reflective baffle, under an embodiment. For the embodiment of FIG. 6, transducer array 604 is mounted in the casing 602 of a portable device such that one diaphragm projects sound directly out of a surface (e.g., upwards) from the device while the other diaphragm projects sound out the opposite side or surface. A baffle or blocking structure 606 may be attached to that surface of the device to cause the sound to be reflected in a particular direction, (e.g., sideways and downwards) as shown. Such a reflection may be caused by mounting the transducer array on the body of the device such that a table or desk surface constitutes the reflective surface for the bottom projecting transducer. Alternatively, an externally coupled baffle (as shown) or device case, such as mobile phone hard case, may be used to provide the reflective surface. The configuration of the reflective surface may be configured such that it imparts a desired attenuation or reverberation effect to the direct audio signal to provide spatial effects or location cues for audio objects or channels.

Figure 7A:
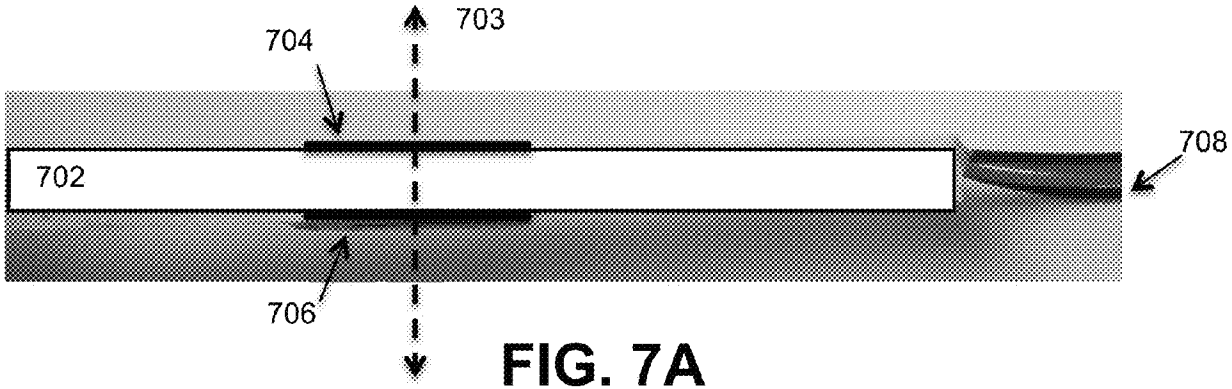
FIG. 7A illustrates a side view of a physical layout of the force balanced micro transducer array under an embodiment.
Figure 7B:
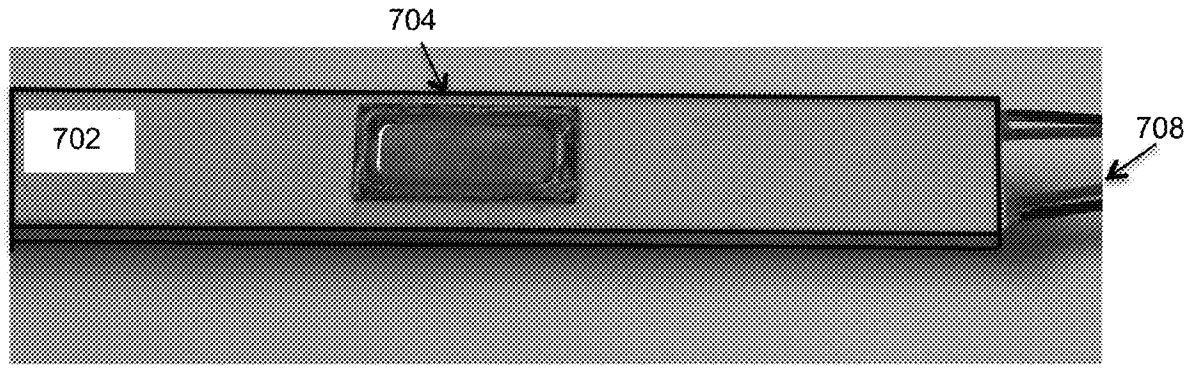
FIG. 7B illustrates a top view of the force balanced micro transducer array of FIG. 7A.

FIGS. 7A and 7B illustrate a physical layout of the force balanced micro transducer array under an embodiment, with FIG. 7A representing a side view and FIG. 7B representing a top view. As shown in FIG. 7A, a body portion 702 has a first transducer 704 mounted on a top surface and a second transducer 706 mounted on a bottom surface. The two transducers are aligned to an axis 703 so that they radiate outward in equal direction when the same in-phase signal is applied to both transducers. Respective pairs of audio wires 708 provide the audio signals to the transducers 704 and 706. FIG. 7B illustrates a top view showing transducer 704 mounted in the top surface of the body 702. The size and width of the body 702, and each of the transducers 704, 706 can be configured based on the size and constraints of the device into which they are mounted. For most portable applications, the width of the body 702 is on the order of ¼ to ½ inch thick, or similar. In this case, the transducer size will be on the order of ¼"×½"×¾" or similar. Any other appropriate dimension is possible. In general the sizes of the two transducers and their distance from the midpoint of the body 702 should be the same to achieve balanced vibration reduction when the same audio signal is applied to both transducers.

As shown in FIG. 5, any practical number of micro transducer arrays may be placed in a device, such as four arrays placed in the corners of a phone 502 or tablet or notebook computer lid. The four (or any other number) of transducer arrays may each comprise an individual channel for playback of channel based audio (e.g., surround sound audio), or they may be configured to play sets or pairs of channels (e.g., stereo, four-channel audio, etc.).

Embodiments are directed to a force balanced micro transducer array that uses opposing diaphragms or drivers that share common motor components. The opposing driver design mitigates vibration and electroacoustic distortion (buzz) caused by the relatively small size of rare earth magnets used in the speakers. Signal inputs to the transducers in the array may comprise phase-shifted inputs for the same audio program to provide opposing forces that counteract movement of the motor against the device casing when the diaphragms move. Alternatively, signal inputs to the transducers in the array may comprise different signals so that different audio content may be output through the opposite sides of the transducer array. The transducer array is configured to be mounted in a small portable device such that one diaphragm projects sound out of one surface or side of the device, and the other diaphragm projects sound out of the opposite surface or side of the device.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," and "hereunder" and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. An apparatus comprising:

a shared motor system having a base plate and flexible mounting interfaces to a frame of a portable electronic device;

a first transducer comprising a first magnet disposed between the base plate and a first top plate, a first diaphragm, and a first voice coil configured to move the first diaphragm in dependence on excitation of the first voice coil;

a first flexible mounting interface coupling the first diaphragm to project sound out of a first aperture located on a first surface of the frame;

a second transducer comprising a second magnet disposed between the base plate and a second top plate, a second diaphragm, and a second voice coil configured to move the second diaphragm in dependence on excitation of the second voice coil;

a second flexible mounting interface coupling the second diaphragm to project sound out of a second aperture located on a second surface of the frame, wherein the second surface is directly opposite the first surface on the frame;

a first pair of input terminals for inputting a first audio signal to the first transducer to excite the first voice coil; and a second pair of input terminals for inputting a second audio signal to the second transducer to excite the second voice coil; wherein the first and second audio signals are configured to maximize a force balancing effect of operation of the oppositely projecting first and second diaphragms to minimize vibration effects on the frame.

2. The apparatus of claim 1 wherein the first and second transducers comprise a transducer array that is configured to be of a size approximating 1 inch long by 1/2 inch wide by 1/4 inch deep, and wherein the frame comprises a lid of the portable electronic device and includes a display screen, and further wherein the first and second apertures are disposed in an upper corner of the frame.

3. The apparatus of claim 2 wherein the first and second magnets each comprise a neodymium magnet.

4. The apparatus of claim 1 wherein the second audio signal comprises the first audio signal in a phase relationship of one of: zero degree in-phase, and out-of-phase up to a 180 degree phase shift.

5. The apparatus of claim 1 wherein the second audio signal is different than the first audio signal.

6. The apparatus of claim 1 wherein the second audio signal is dependent on the first audio signal and augments the first audio signal to produce a desired sound effect for the first audio signal.

7. The apparatus of claim 6 further comprising one or more reflective baffles associated with the opposite surface of the device and configured to reflect sound projected from the second transducer.

8. The apparatus of claim 7 wherein the portable device is selected from the group consisting of: a laptop computer, a notebook computer, a tablet computer, a mobile phone, and a handheld game device.

9. A portable electronic device comprising:

a body portion having a first surface and an opposite facing second surface wherein the first and second surfaces are disposed on an order of 1/4 inch to 1/2 inch apart; and a force balanced micro transducer array placed in the body portion and having a shared motor system with a base plate and flexible mounting interfaces to the body portion; a first transducer comprising a first magnet disposed between the base plate and a first top plate, a first diaphragm coupled to the body portion through a first flexible mounting interface and configured to project sound out of a first aperture in the first surface, and a first voice coil configured to move the first diaphragm in dependence on excitation of the first voice coil; a second transducer comprising a second magnet disposed between the base plate and a second top plate, a second diaphragm coupled to the body portion through a first flexible mounting interface and projecting sound out of a second aperture in the second surface, and a second voice coil configured to move the second diaphragm in dependence on excitation of the second voice coil, wherein the second surface is directly opposite the first surface on the body portion, the array outputting first and second audio signals configured to maximize a force balancing effect of operation of the oppositely projecting first and second diaphragms to minimize vibration effects on the body portion.

10. The device of claim 9 further comprising:

a first pair of input terminals for inputting the first audio signal to the first transducer to excite the first voice coil; and a second pair of input terminals for inputting the second audio signal to the second transducer to excite the second voice coil.

11. The device of claim 10 wherein the first and second transducers comprise a transducer array that is configured to be of a size approximating 1 inch long by 1/2 inch wide by 1/4 inch deep.

12. The device of claim 9 wherein the second audio signal comprises one of: the first audio signal shifted in phase by 180 degrees, and a different audio signal than the first audio signal.

13. The device of claim 12 wherein the second audio signal is dependent on the first audio signal and augments the first audio signal to produce a desired sound effect for the first audio signal.

14. The device of claim 9 further comprising one or more reflective baffles associated with the opposite surface of the device and configured to reflect sound projected from the second transducer.

15. The device of claim 9 wherein the portable device is selected from the group consisting of: a laptop computer, a notebook computer, a tablet computer, a mobile phone, and a handheld game device.

* * * * *